United States Patent [19]

Barkhuus

[11] 4,038,930

[45] Aug. 2, 1977

[54] FURNACE FOR INCINERATING REFUSE

[76] Inventor: Per W. Barkhuus, 1699 Chesalles-sur-Oron, Switzerland

[21] Appl. No.: 667,609

[22] Filed: Mar. 17, 1976

[51] Int. Cl.[2] ..... F23G 5/00

[52] U.S. Cl. ..... 110/8 A; 110/8 C; 110/56

[58] Field of Search ..... 110/8 R, 8 A, 8 C, 119, 110/56, 18 C

[56] References Cited

U.S. PATENT DOCUMENTS

| | | | |
|---|---|---|---|
| 3,567,399 | 3/1971 | Altmann et al. | 110/8 |
| 3,610,179 | 10/1971 | Shaw, Jr. et al. | 110/8 |
| 3,791,317 | 2/1974 | Schrage et al. | 110/8 |
| 3,797,413 | 3/1974 | Ali et al. | 110/8 |
| 3,837,302 | 9/1974 | Bersier | 110/8 |

*Primary Examiner*—Kenneth W. Sprague
*Attorney, Agent, or Firm*—William E. Cleaver

[57] ABSTRACT

The present device is a refuse incinerator and includes a combustion chamber, a primary source of air disposed to provide first air to said chamber to effect a first combustion therein; an escape orifice for combustion gases, resulting from the combustion of refuse, provided in at least one of the walls of said chamber; means for supplying pre-heated air from a second source into said combustion chamber in a direction substantially opposite to the direction along which combustion gases with particles suspended therein, from said first combustion, pass toward said escape orifice.

8 Claims, 4 Drawing Figures

FURNACE FOR INCINERATING REFUSE

The present invention relates to furnaces for incinerating refuse.

Furnaces for burning refuse must be capable of burning very differing materials and it is important that these materials burn completely and that the gases and particles in suspension resulting from such combustion are also burnt. In many cases, the volume of combustion gases released and the humidity of the material to be burnt is very high and the air normally drawn into the combustion chamber is insufficient. Accordingly, ignition and combustion of the gases cannot proceed to completion so that a relatively large volume of unburnt gas is discharged into the atmosphere.

It has been attempted to increase the time period that the gas remains in the combustion chamber by increasing the dimensions of the chamber. However, whilst this enables the refuse to undergo a slow and therefore relatively complete combustion particularly in the case of materials which do not burn easily, it simultaneously causes thermal losses which adversely affects the combustion the gases and the particles in suspension.

It has also been suggested that a secondary air supply be introduced into the combustion chamber, This should facilitate the combustion of gases and the particles in suspension. However, the desired results are not obtained since such an arrangement assists the gases and particles in suspension to escape without having been mixed with the air to ensure complete combustion.

According to the present invention, there is provided a furnace for incinerating refuse comprising a combustion chamber an escape orifice for gas and particles in suspension resulting from the combustion of waste being provided in at least one of the walls of the chamber wherein means for supplying secondary pre-heated combustion air under pressure are disposed around the escape orifice and said means being adapted to direct the secondary combustion air into the combustion chamber in a direction substantially opposite to the direction in which gas and particles in suspension pass through the orifice.

The invention will be further described by way of example, with reference to the accompanying drawings, in which.

Figure 1:
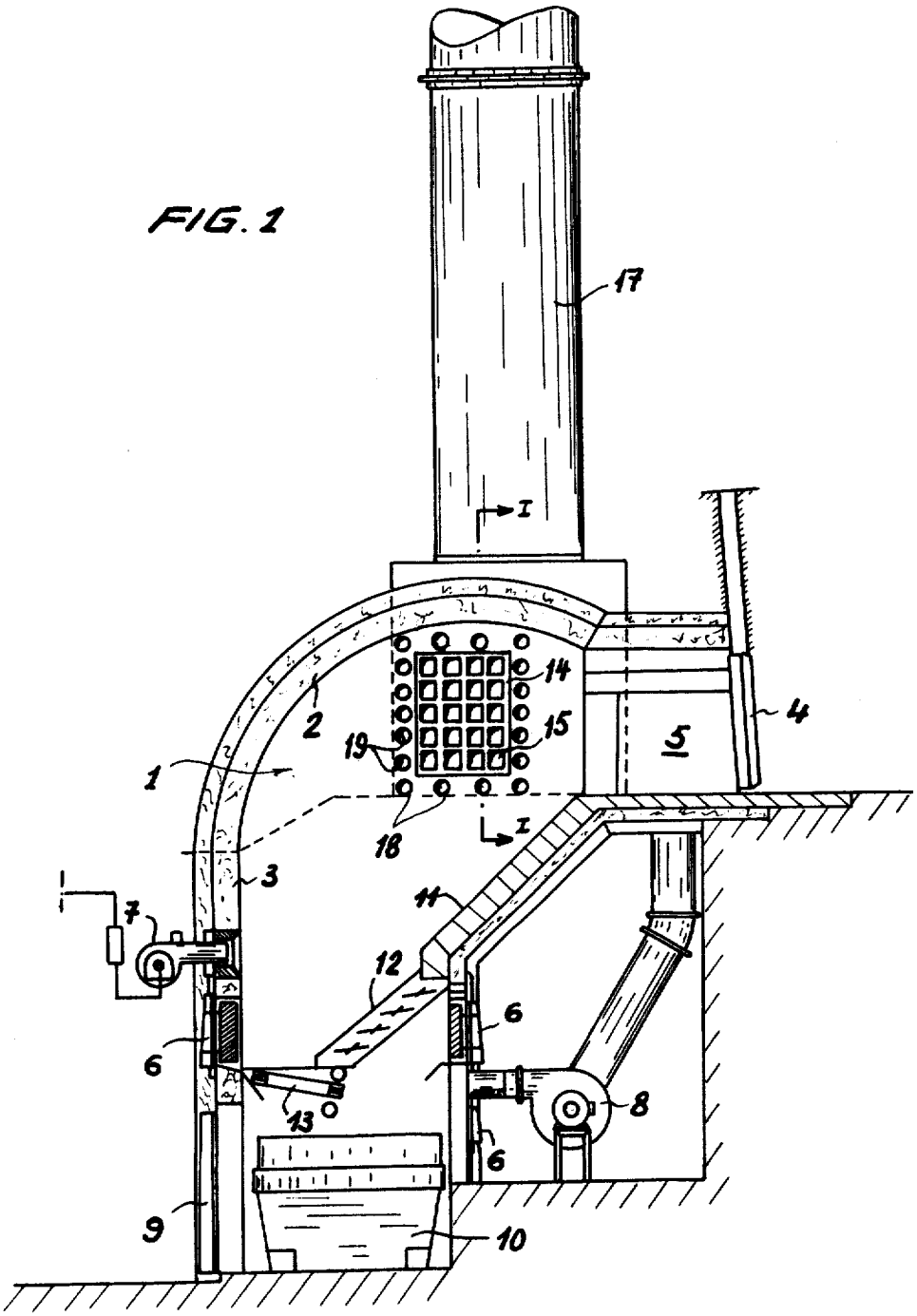
FIG. 1 is a transverse section of a furnace in accordance with the present invention.
Figure 2:
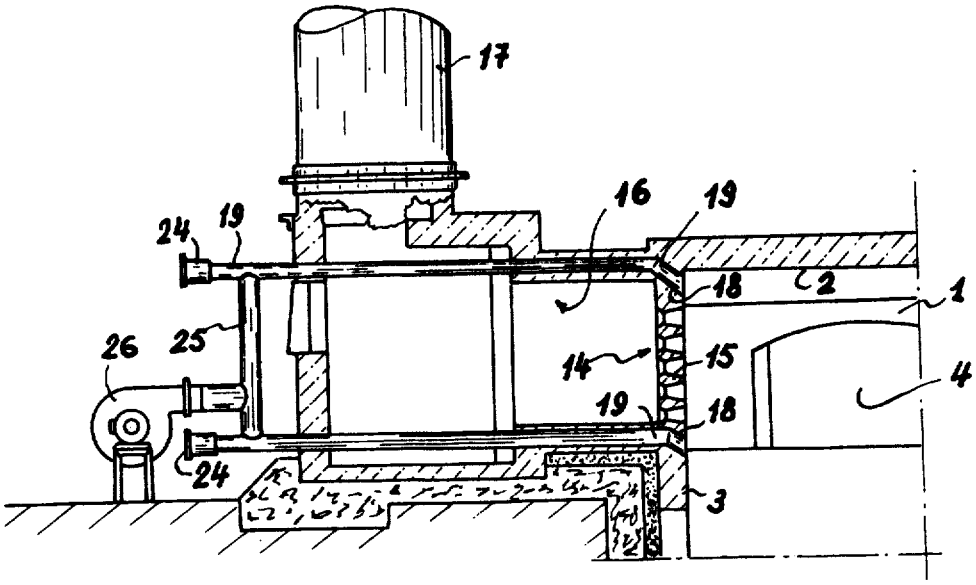
FIG. 2 is a partial section taken along the line I—I of FIG. 1.

As shown in FIGS. 1 and 2, a furnace comprises a combustion chamber 1 having a vault 2 of generally circular form located on an assembly of lateral walls 3. The lateral walls are provided, in a known manner, with a sliding loading door 4 which masks an orifice 5 through which the refuse is loaded into the furnace, an inspection traps 6, a burner 7 fed with fuel from a reservoir (not shown), a blower 8 through which primary combustion air enters the chamber 1 and which is disposed in the lower region of the chamber, and a door 9 allowing access to a pan 10 which receives the ashes.

Inside the chamber 1, and extending from the orifice 5 through which the refuse is loaded, is an inclined pre-heating bedplate 11 followed leg a mixing grating 12 and a secondary grating 13, these two gratings being located above the pan 10 which receives the ash. These components of a furnace are known, and will not be described in any further detail.

One of the lateral walls 3 of the chamber 1 is provided, in its upper region, with an aperture 14 through which gas and smoke can escape from the chamber, this orifice being covered by a ceramic grating 15 which acts as a filter. The aperture 14 is connected by a conduit 16, as shown in FIG. 2, to a chimney 17.

Figure 3:
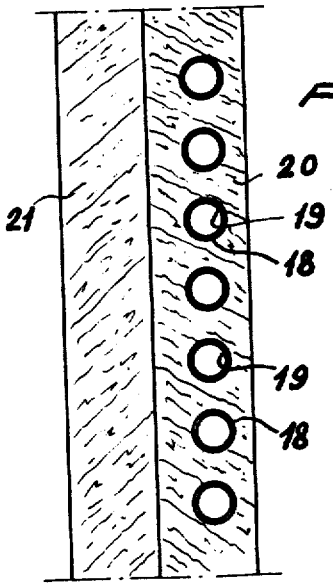
FIG. 3 is a section on an enlarged scale relative to FIGS. 1 and 2 of a detail of the furnace.
Figure 4:
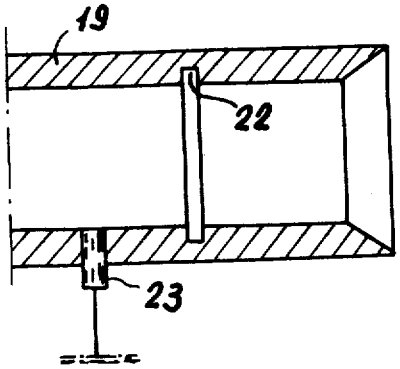
FIG. 4 is a section, also on an enlarged scale relative to FIGS. 1 and 2 of a further detail of the furnace.

Around the opening 14, and bordering the grating 15, the wall of the chamber 1 has a series of apertures 18.. In each of these apertures 18, an input means or tube 19, preferably made of stainless steel, is provided for the input of secondary combustion air. Each of the tubes 19 passes through the wall around the channel 16 and are embedded therein. As shown in FIG. 2, part of each tube 19 is embedded in the wall and the other part thereof extends exposed through the channel 16. This, however, is not essential and the tubes 19 can, if desired, be completely embedded in the wall surrounding the channel 16. The walls in which the tubes 19 are partially or completely embedded aıe provided with a first layer 20, as shown in FIG. 3, of a refractive material which is a good heat conductor, the exterior of this first layer being itself covered with a second layer 21 of insulating refractory material. Thus, the heating effect set up by the passage of combustion gases and smoke through the channel 16 is transmitted to the tubes 19.

Each tube 19 is provided, in its end region where it opens into the combustion chamber 1, with transverse groove or interior throat 22 adapted to the formation of an ultrasonic flow. Moreover, at least one of the tubes 19 carries, in the end region opening into the combustion chamber 1, a temperature probe 23. Preferably, at least two temperature probes are used, one being disposed in each of the tubes situated on each side of the aperture 14 for the escape of gas and smoke.

The other end of each of the tubes 19 opens into the outside of the furnace and is masked by a movable plug 24 permitting access to the inside of the tubes, for example, for cleaning them. Also outside the furnace, the tubes 19 are inter-connected by small conduits 25 connected to a blower 26 for supplying secondary combustion air at a varialbe flow rate. Preferably, at least two variable flow blowers each separately feeding a group of tubes 19 disposed respectively on each side of the medial plane of the escape orifice 14, which permits having different air flow rates on the opposed sides of the orifice 14. The flow rate of each blower 26 can be controlled manually. Nevertheless, it is preferable to control them by the intermediary of the temperature probe or probes 23, this control being effected by means of a known circuit which will not be described in detail since it forms no part of the present invention.

Thus, the tubes 19 provide a flow of combustion air, under pressure, around the escape orifice for the gas and the smoke in a direction opposite to that of the escaping gas and smoke. The tubes 19 are strongly heated by virtue of the high temperatures prevailing in the channel 16, and the air driven into the said tubes by the blower or blowers 26 will thus be pre-heated before penetrating into the furnace. Since the temperature of the air coming out of the tubes 19 is a function of its flow rate, by controlling the effect of the blower or blowers 26 will permit this temperature to be changed as desired. Conversely, the air flow from the blower or blowers 26 can be controlled by means of the temperature probe or probes 23, and the air issuing from the outlets of the tubes may be maintained at a constant temperature. If a plurality of blowers are used, it is possible to provide an air flow which is greater in certain regions and consequently set up an air temperature gradient. This can be servo-regulated if the regulation of the flow of the blowers is effected automatically by means of the temperature probes.

Because the inflow of secondary pre-heated combustion air under pressure is effected adjacent the escape orifice for gas and smoke, the rate of discharge of gas and particles in suspension is retarded, thereby prolonging the length of time that they remain in the furnace. Moreover, such an arrangement causes intimate mixing of the gas and smoke with the secondary combustion air, this mixing being effected without loss of heat since the secondary air has been pre-heated. A slow and complete combustion of the gas and particles in suspension can thus be obtained without it being necessary to increase the dimensions of the combustion chamber.

In the furnaces in which, as in the example shown, the intake orifice for the waste and the orifice for the escape of gas and smoke are in close proximity to one another, the intake of secondary air under pressure around the escape orifice and in contra-current thereto prevents the waste passing through escape orifice without having been burnt.

Finally, by virtue of the presence, of the grooves for providing an ultra-sonic flow on the end of the tubes 19, the secondary combustion air leaving the tubes 19 produces a vibrational energy field at high frequency which considerably facilitates the mixing of the gases and particles in suspension with the secondary combustion air, which greatly improves the conditions of ignition and combustion of the gases and particles in suspension.

As aforementioned, the vault 2 of the combustion chamber 1 is of generally circular form. This arrangement permits a good distribution of secondary combustion air, under pressure, in the combustion chamber which improves its intimate mixing with the gas and the particles in suspension and, in consequence, the ignition and combustion thereof. Whilst, this is preferred, such an arrangement is not essential and the vault may be in other desired forms.

What I claim is:

1. A furnace for burning refuse comprising in combination: a combustion chamber having at least a first orifice and a second orifice formed therein, said first orifice disposed to permit unburned refuse to be loaded into said combustion chamber, said second orifice disposed to permit combustion gases to leave said combustion chamber; means including a first source of air to effect a first burning of refuse in said combustion chamber whereby combustion gases, including unburned particles of refuse suspended therein, are created and directed toward said second orifice; a second source of air; heating means connected to said second source of air and to said combustion chamber in close proximity to said second orifice and formed to heat air from said second source and further formed to direct said heated air from said second source into said combustion chamber in a direction substantially opposite to the direction along which said combustion gases and suspended particles, from said first combustion, are moving toward said second orifice to effect a second burning of said suspended particles in said combustion chamber with a minimum loss of heat resulting from the introduction of said second air.

2. A furnace according to claim 1 wherein said heating means is a heat exchanger means formed to receive combustion gases through said second orifice and extract heat therefrom to heat air from said second source of air.

3. A furnance according to claim 2 wherein said heat exchanger means includes a plurality of pipes which are at least partially held in a wall of refractory material which material is a good thermal conductor of heat and which refractory wall is itself covered on its exterior with an insulating refractory material.

4. A furnace according to claim 3 wherein each of said pipes has an end section opening into said combustion chamber and wherein in each of said end sections there is formed a groove to produce a flow of ultrasonic air.

5. A furnace according to claim 1 wherein there is further included means to monitor the temperature of the air in said heating means in order to adjust the temperature of said air.

6. A furnace according to claim 5 wherein said second source of air includes at least one variable air flow blower and wherein the temperature of said air in said heating means is adjusted by varying the air flow from said blower.

7. A furnace according to claim 1 wherein said heating means includes a first and second plurality of pipes and wherein said second source of air includes first and second variable air flow blowers with said first variable air flow blower connected to said first plurality of pipes and said second variable air flow blower connected to said second plurality of pipes.

8. A furnace according to claim 7 wherein there is further included a final temperature control means coupled to said first plurality of pipes and to said first variable air flow blower and wherein there is further included a second temperature control means coupled to said second plurality of pipes and to said second variable air flow blower whereby the air flow passing through said first and second plurality of pipes is controlled by the temperature of said air.

* * * * *